US005136941A

United States Patent [19]

Lübke et al.

[11] Patent Number: 5,136,941

[45] Date of Patent: Aug. 11, 1992

[54] DOCTOR BLADE APPARATUS

[75] Inventors: Herbert Lübke, Lienen; Volker Schröder, Lengerich, both of Fed. Rep. of Germany

[73] Assignee: Windmoller & Holscher, Lengerich, Fed. Rep. of Germany

[21] Appl. No.: 591,235

[22] Filed: Oct. 1, 1990

[30] Foreign Application Priority Data

Oct. 10, 1989 [DE] Fed. Rep. of Germany ..... 3933844

[51] Int. Cl.[5] ..... B41F 9/10

[52] U.S. Cl. ..... 101/157; 101/365

[58] Field of Search ..... 101/157, 169, 365, 366; 118/261

[56] References Cited

U.S. PATENT DOCUMENTS 3,783,781 1/1974 Grommek ..... 101/157
4,373,445 2/1983 Köbler ..... 101/169 X
4,485,738 12/1984 Gertsch et al. ..... 101/169 X
4,638,733 1/1987 Schneider et al. ..... 101/169 X
4,773,327 9/1988 Moetteli ..... 101/169 X

FOREIGN PATENT DOCUMENTS 2057689 12/1971 Fed. Rep. of Germany .

*Primary Examiner*—Edgar S. Burr
*Assistant Examiner*—Moshe I. Cohen
*Attorney, Agent, or Firm*—Fleit, Jacobson, Cohn, Price, Holman & Stern

[57] ABSTRACT

Doctor blade apparatus for use with a form cylinder of a printing machine has a doctor blade holder which is mounted in a series of slide assemblies spaced along the length of the blade holder so that the holder can be adjusted both in directions parallel to and perpendicular to the cylinder axis thereby providing accurate positioning of the blade on the cylinder.

6 Claims, 6 Drawing Sheets

DOCTOR BLADE APPARATUS

BACKGROUND OF THE INVENTION

This invention relates to a doctor blade apparatus, having a doctor blade fastened in a doctor blade holder to be positioned along a cylinder capable of taking up paint, or ink, for example a form cylinder of a printing machine for intaglio engraving.

With doctor blade apparatus of this kind there exists the problem of positioning the doctor blade with constant pressure over its whole length against the cylinder, even if the surface line of the cylinder which abuts the doctor blade, is not exactly parallel to the cutting edge of the blade, which is e.g. the case when the axis of the cylinder is not parallel to the edge of the blade or if the cylinder has a conical shape.

In a doctor blade apparatus which is disclosed in DE-AS 12 73 540, good pressure of the doctor blade against the form cylinder is achieved in that a member rotatable around a central axis perpendicular to the pivot shaft of the doctor blade holder carries a pair of stud journals, the rotatable part of which carries the doctor blade holder and the central axis of which also extends in the center of the doctor blade holder at an angle perpendicular the central axis of the rotatable member. With this doctor blade apparatus, the doctor blade can be urged against the form cylinder with a good degree of parallelism because of the centered mounting of the doctor blade, allowing swing and bob movements. This known doctor blade apparatus is however not wholly satisfactory, since good abutting of the doctor blade against the surface of the form cylinder is obtained only when the blade is relatively short. This is because with longer blades and corresponding doctor blade holders, vibrations occur in the end regions thereof because of the central pivoting, said vibrations causing bad quality blading in the end regions of the form cylinder.

In another doctor blade apparatus disclosed in DE-AS 12 28 276, doctor blade holders are supported by a twistable doctor blade holder shaft having a rotating arm, said doctor blade holder shaft being journalled in pivot arms rotatable independently of each other, wherein an elastic force effective in the direction towards the form cylinder can be exerted on the pivot arm and on the rotating arm. This doctor blade apparatus also only works in a satisfactory manner if the doctor blade holder shaft supporting the lever-like doctor blade holders is not too long, since otherwise the doctor blade holder shaft can bend in its central area by an excessive amount, with the consequence that doctoring is imperfect in the center area of the form cylinder.

SUMMARY OF THE INVENTION

It is an object of the invention to provide a doctor blade apparatus of the kind mentioned above, in which the blade can be urged against the cylinder with essentially even pressure, irrespective of the length of the doctor blade holder.

According to the invention, the doctor blade holder is rotatably connected with sledge or slide-like supporting members, by way of a plurality of pivot pins equal in number to the supporting members, said pins being provided perpendicularly to the longitudinal axis of the doctor blade holder, said supporting member being movably guided in recesses extending perpendicular to the cylinder, and the doctor blade holder being urged towards the cylinder by way of a plurality of elastic urging means distributed over its full length, e.g. piston cylinder units driven by pressure fluid.

The sledge or slide-like supports provide that the doctor blade holder can be urged with essentially even pressure towards the cylinder, and the studs supporting the doctor blade holder with respect to the supports allow for turning of the doctor blade holder with respect to the supports. The urging means can be arranged selectively over the length of the doctor blade holder and can urge against the doctor blade holder or even against the slide-like supports. As the number of urging means provided along the length of the doctor blade holder is selected according to the length of the blade, even and substantially vibration free abutting is established even with very long doctor blades and corresponding doctor blade holders.

Preferably, an urging means is arranged for each slide-like support. The supports can be guided in slides provided with a drive for reciprocating the slides parallel to the cylinder. This reversing drive provides that the blade stays in contact with essentially the same circumferential area of the cylinder.

The urging means can be formed of pneumatic piston cylinder units, which are supported on one side by the doctor blade holder and on the other side by holding means on the slide.

BRIEF DESCRIPTION OF DRAWINGS

An embodiment of the invention will be described below with reference to the drawings, in which.

DESCRIPTION OF PREFERRED EMBODIMENTS

Figure 1:
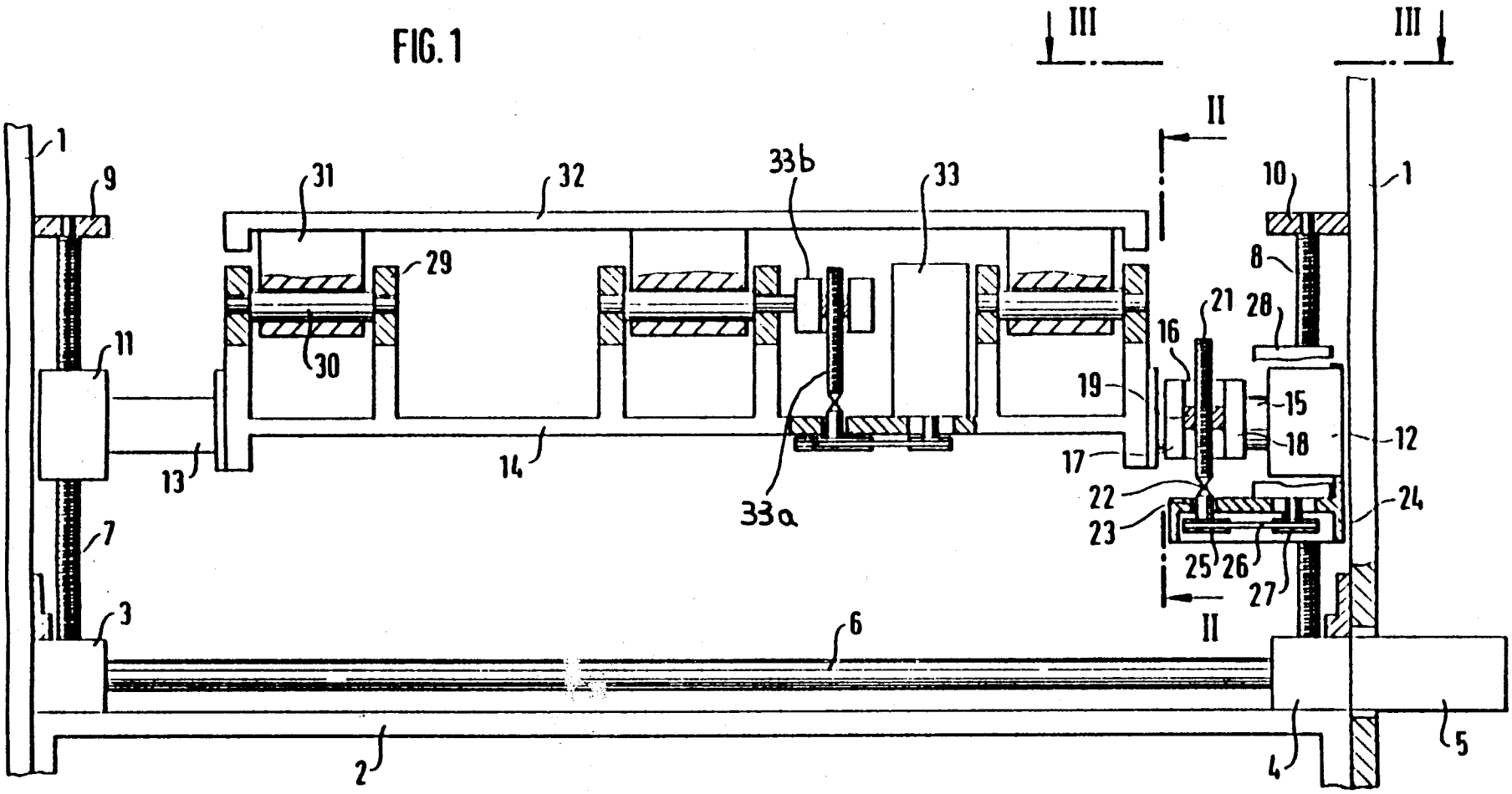
FIG. 1 is a front view of a doctor blade apparatus, partially in section.

Two side walls of a machine frame are connected with each other by way of a bridge piece 2 (FIG. 1). Gear-boxes 3 and 4 are screwed to the inside of each side wall 1, and a motor 5 drives gear-box 4. Gear-boxes 3 and 4 are connected with each other via a shaft 6. Screw spindles 7 and 8 driven by motor 5 via gear-boxes 3 and 4 are supported in the area of their ends remote to the gears 3 and 4 by supporting brackets 9 and 10 connected to side walls 1. Bearings 11 and 12 provided with nuts not shown are placed on screw spindles 7 and 8. In bearing 11 shown on the left hand side of FIG. 1, a rod 13 is rotatably mounted, said rod being firmly connected to one side of molded frame 14. As in bearing 11, the bearing 12 shown on the right side of FIG. 1 has a rod 15 rotatably mounted therein, its end remote to bearing 12 being firmly connected to the right hand side of molded frame 14. A clamping lever 16 is mounted on rod 15 said clamping lever having a fork-like form at its side facing the gear in FIG. 3. In the two fork arms 17 and 18, a bolt 19 is rotatably journalled, said bolt having a centered thread bore. Into this thread bore a threaded spindle 21 is screwed, having a joint 22 at its lower end (FIG. 1). Threaded spindle 21 is connected to a shaft stub 23 via said joint 22, said shaft stub being non-axially inclined and rotatably journalled in a supporting frame, 24. A pulley 25 is mounted on the end of the shaft stub 23 remote from joint 22, said pulley being connected via a V-belt 26 with a further pulley 27. Pulley 27 is driven by a motor 28, said motor being firmly connected to supporting frame 24. Supporting frame 24 is fastened to bearing 12.

By actuating motor 5 bearings 11 and 12 can be driven up and down, whereby molded frame 14 can be lifted and lowered by means of rods 13 and 15. By additionally actuating motor 28 (FIG. 3) the molded frame 14 can additionally be pivoted by way of threaded spindle 21, bolt 19 and clamping lever 16.

Molded frame 14 has a plurality of spaced supports 29 wherein pairs of adjacent supports 29 support respective shafts 30. Arms 31 are supported by the three shafts 30, said arms being firmly connected to a blade holder 32. As can be seen in FIG. 1 a further motor 33 is flanged to molded frame 14, via which the blade holder 32 can be pivoted with respect to molded frame 14 through screw 33*a* and lever 33*b*, in like manner to the pivoting of molded frame 14 by way of motor 28, screw 21 and lever 16, so that no further explanation is necessary.

Figure 2:
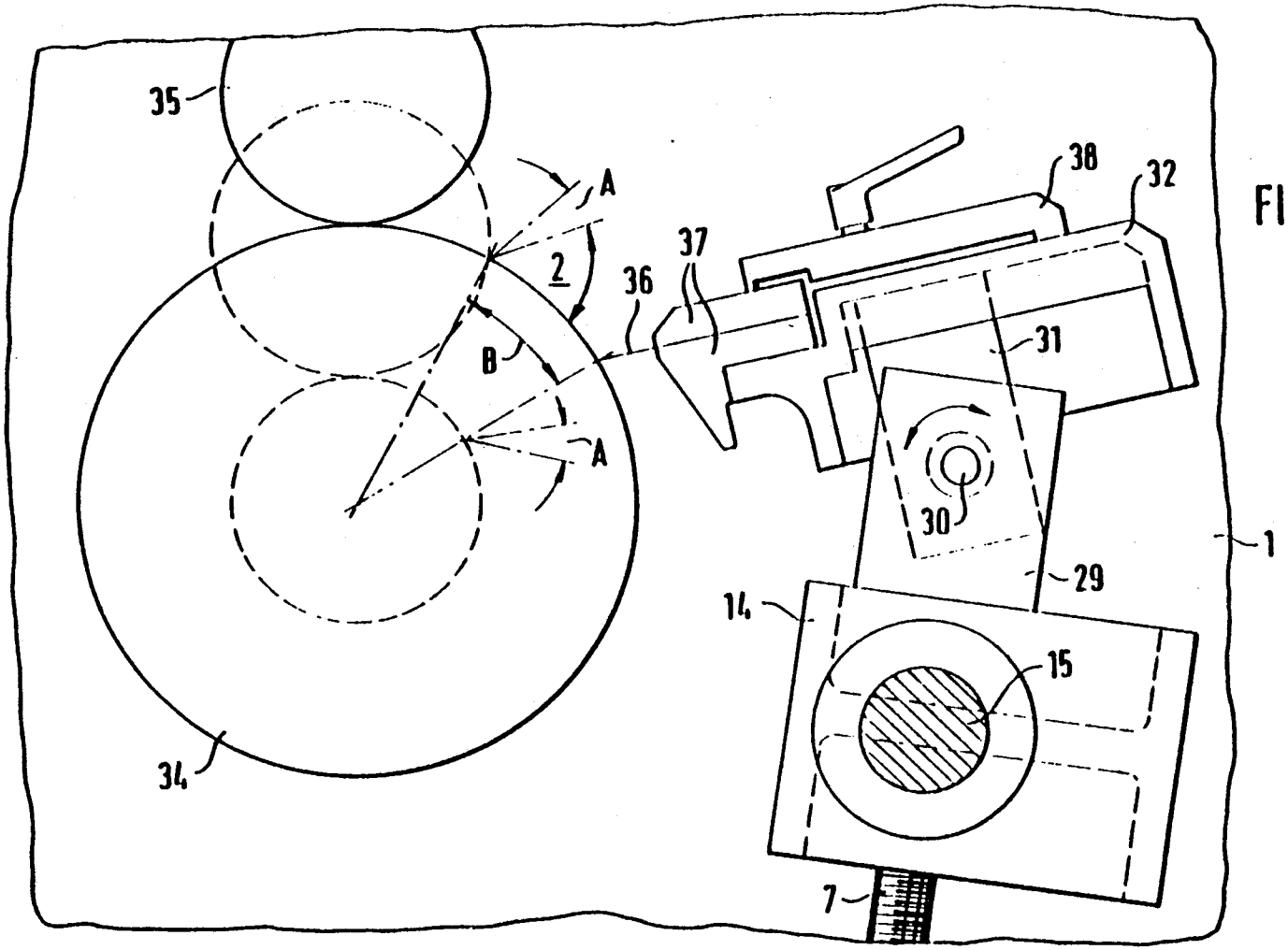
FIG. 2 is a sectional view on line II—II of FIG. 1.

In FIG. 2 a form cylinder 34 and a presser 35 are shown in full lines. Doctor blade 36 abuts form cylinder 34, the doctor blade being connected to doctor blade holder 32 via clamping devices, 37 and a stretching paw 38. By way of actuating motors 5, 28, and 33, the doctor blade can be brought into different angles B, the degree of dryness of the color being influenced by the set angle. (The further the doctor blade is away from the presser, the longer the way the rated inlets of the form cylinder have to go to the presser, wherein a high degree of dryness is achieved.) Further, by way of equivalent actuation of the three motors 5, 28 and 33 the blade can be set to an angle A, by which the degree of filling of the inlets is defined. (The smaller angel A the higher the degree of filling of the inlets.)

The invention will now be explained with respect to FIGS. 4 to 6, which distinguish from FIGS. 1 to 3 in that arms 105 corresponding to arms 31 additionally carry slides 107, 113 which are perpendicularly movable with respect to each other, wherein doctor blade holder 117 is journalled on slide 113 by way of studs and is urged towards form cylinder 120 by urging means as will be described.

Figure 3:
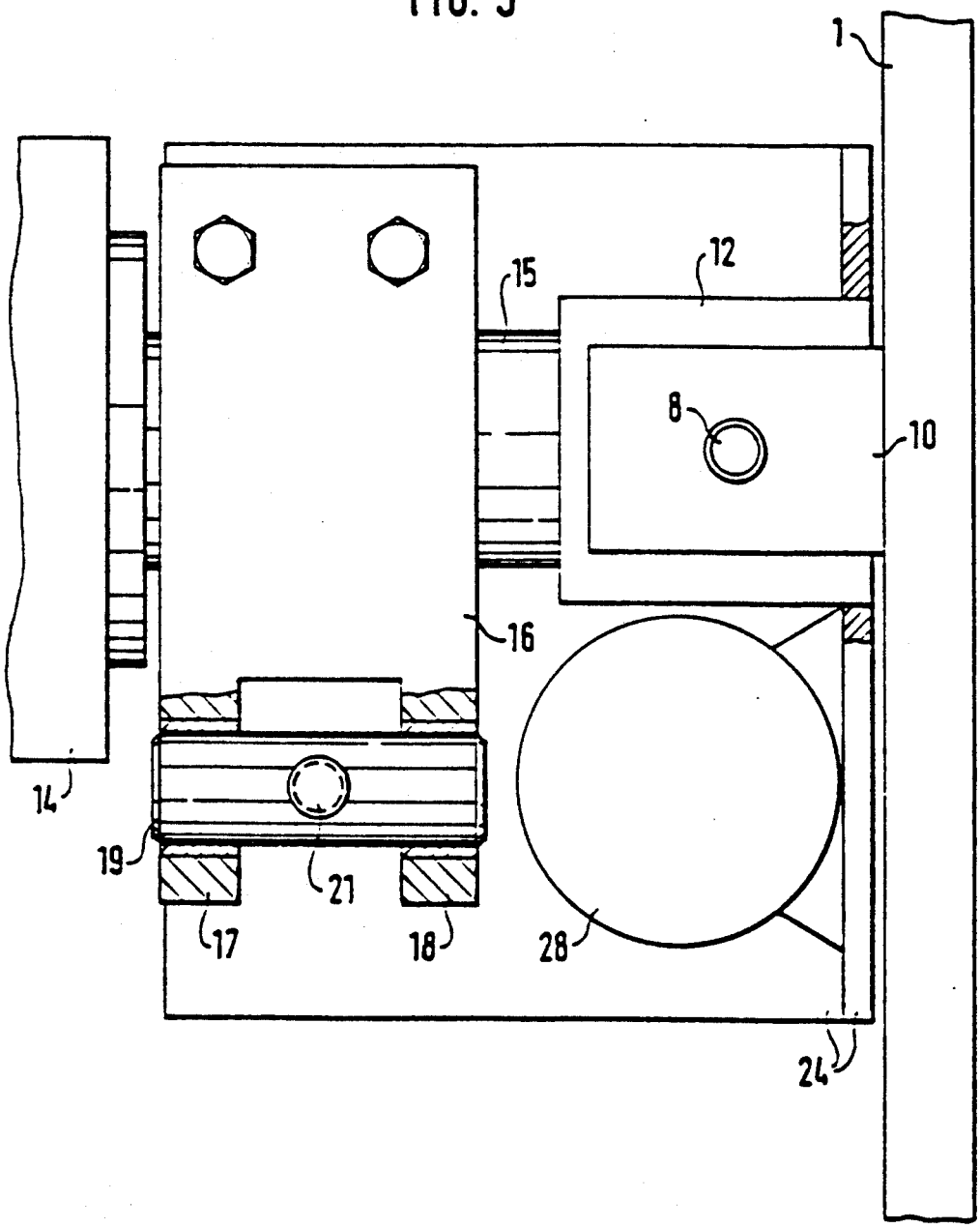
FIG. 3 is an enlarged plan view of a part of the doctor blade apparatus in the direction of the arrows III of FIG. 1.
Figure 4:
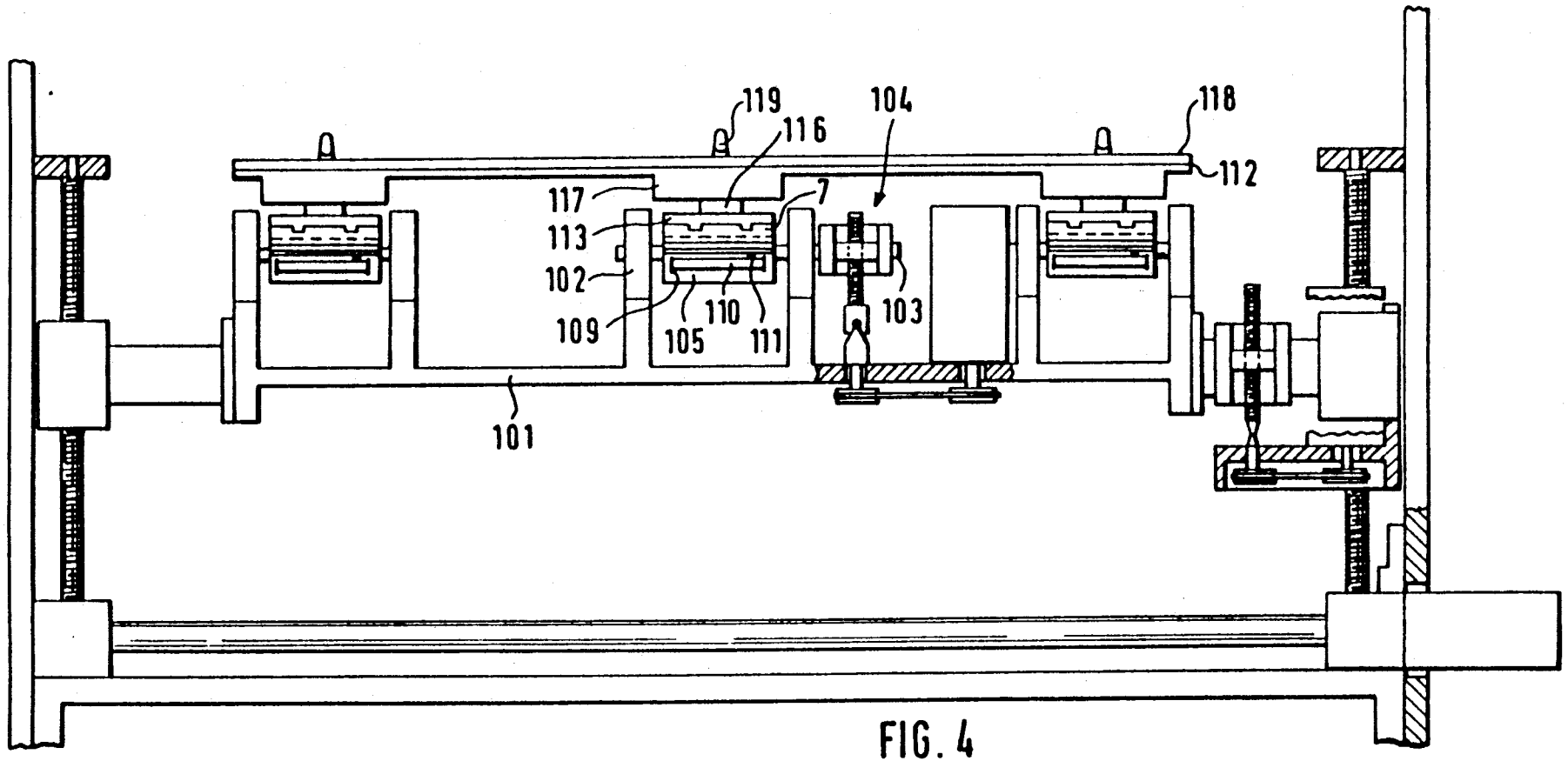
FIG. 4 is a front view of a doctor blade apparatus corresponding to FIG. 1, and comprising a journalling arrangement of the doctor blade holder according to the invention.
Figure 5:
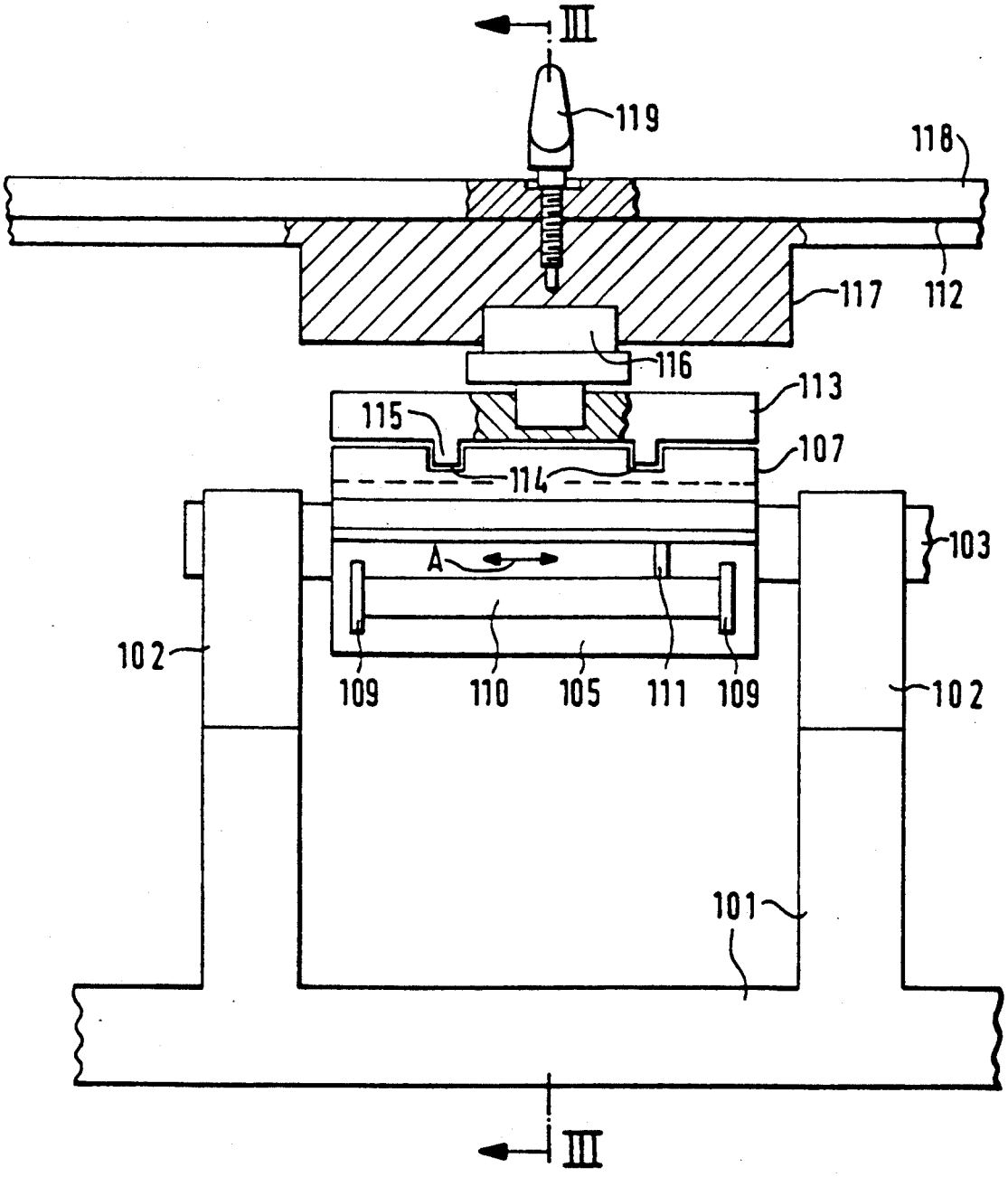
FIG. 5 is an enlarged view of a part of the doctor blade holder shown in FIG. 4.
Figure 6:
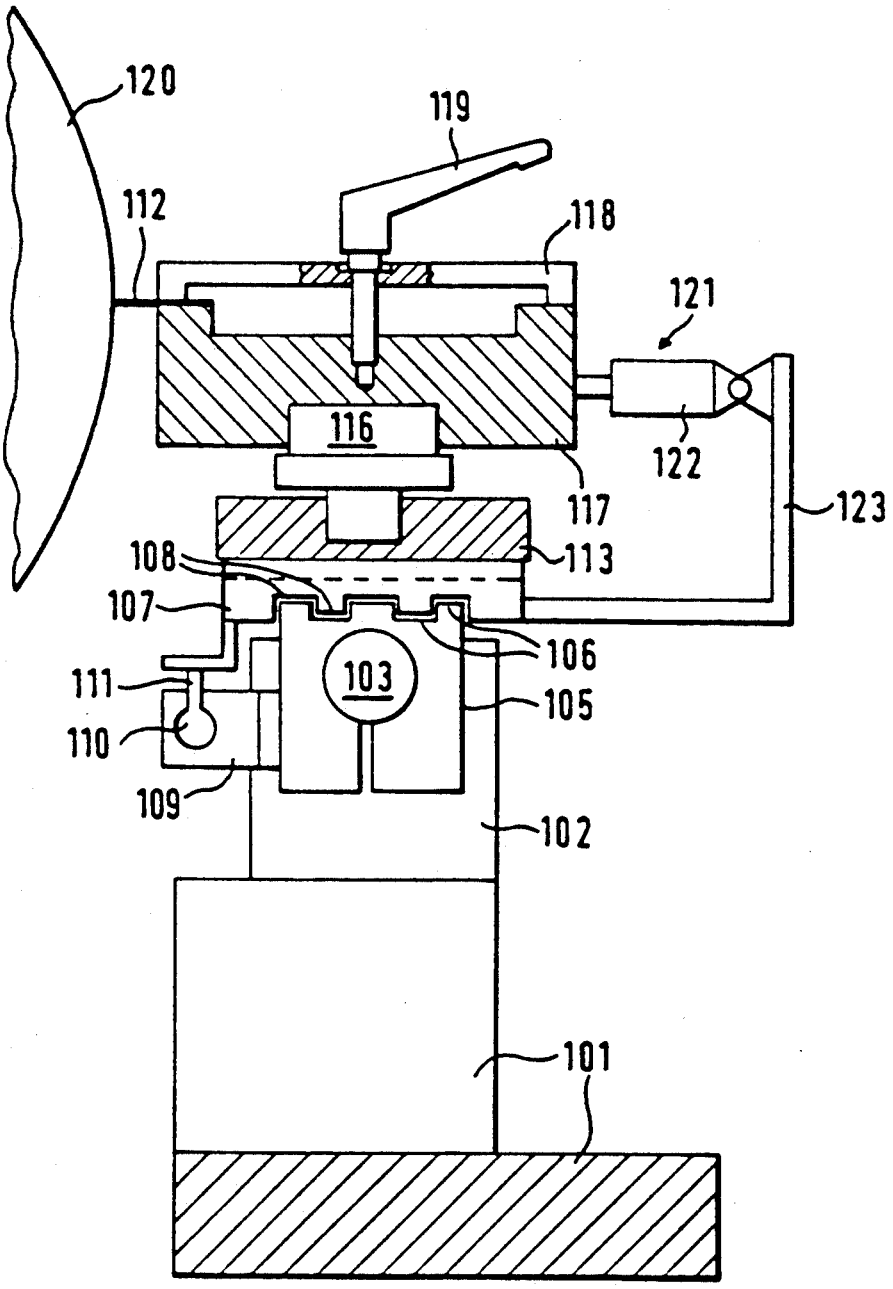
FIG. 6 is a sectional view of the doctor blade holder on line III—III of FIG. 5.

In the embodiment according to FIGS. 4 to 6 the molded frame 101 is vertically movable and pivotably mounted in side frames as in the manner described with respect to FIGS. 1 to 3.

The molded frame 101 is provided with a plurality of supports 102, with shaft 103 journalled in respective adjacent supports. Pivoting of each shaft is effected by an adjusting device 104 in like manner to the FIG. 1 arrangement. On each shaft 103 an arm 105 is clamped which has a guide profile 106 in the direction of shaft 103. Onto each arm 105 a slide 107 is mounted which at its lower surface also has a guide profile 108 in the longitudinal direction of shaft 103, said guide profile engaging with guide profile 106. A cylinder unit 110 is in each case connected to arm 105 via supports 109, the cylinder unit having a reciprocable piston-like stud 111 connected to slide 107, which can thus be reciprocated by the stud in the direction of arrow A. This reversing movement, which amounts only to a few millimeters, is transferred to blade 112.

As can be seen in FIGS. 5 and 6, a further slide 113 is mounted on slide 107. For this purpose, slide 107 is provided on its upper surface with two grooves 114 transverse to shaft 103, into which grooves guide profiles 115 connected to slide 113 engage. Each slide 113 carries a guide stud or pivot pin 116, which engages into a bore of blade holder 117 at its end remote to the slide. Each pin 116 is rotatable with respect to slide 113 as well as with respect to the doctor blade holder 117. As can be seen especially from FIG. 6, doctor blade 112 is clamped to doctor blade holder 117 via a clamping member 118 and a tommy screw 119.

Urging of blade 112 towards the form cylinder 120 is effected by respective pneumatic piston cylinder units 121, the cylinders 122 of which are firmly fastened to the respective slides 107 by way of knee joints 123.

Because of the journalling-type mounting of the doctor blade holder 117 as described above the doctor blade evenly abuts form cylinder 120 even when said cylinder is a skew position. On the other hand, doctor blade holder 117 is evenly supported over its whole length, so that it cannot bend. While only three journal points for blade holder 117 are shown in the embodiment, it is self-evident that more journal points can be provided without departing from the scope of the invention.

We claim:

1. Doctor blade apparatus comprising a doctor blade holder and a doctor blade fastened therein and positioned along a cylinder capable of taking up paint or ink such as a form cylinder of a printing machine for intaglio engraving, a plurality of slide-like supporting members spaced lengthwise of the holder, and a plurality of pins extending perpendicularly to the longitudinal axis of the doctor blade holder, guides extending perpendicularly to a vertical plane passing through the central axis of the cylinder, said doctor blade holder being connected to said supporting members by said pivot pins, means for movably mounting said supporting members in said respective guides, and a plurality of elastic urging means distributed over the length of the holder for urging the doctor blade holder towards the cylinder.

2. Doctor blade apparatus according to claim 1, wherein one of the urging means is associated with each supporting member.

3. Doctor blade apparatus according to claim 1, wherein the guides are themselves mounted on slides for movement in parallel to the cylinder axis.

4. Doctor blade apparatus as claimed 3 including drive means for moving the guides along the slides.

5. Doctor blade apparatus according to claim 1, wherein the urging means comprise pneumatic piston cylinder units supported by the doctor blade holder and by supporting members on the respective guides.

6. Doctor blade apparatus according to claim 1, wherein the supporting members are three in number.

* * * * *